US011024949B2

(12) United States Patent
Hu et al.

(10) Patent No.: US 11,024,949 B2
(45) Date of Patent: Jun. 1, 2021

(54) DIPOLE ARM ASSEMBLY

(71) Applicant: CommScope Technologies LLC, Hickory, NC (US)

(72) Inventors: Guanpeng Hu, Shanghai (CN); Youfeng Lu, Shanghai (CN); Liming Wang, Shanghai (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/509,733

(22) Filed: Jul. 12, 2019

(65) Prior Publication Data

US 2020/0028244 A1 Jan. 23, 2020

(30) Foreign Application Priority Data

Jul. 23, 2018 (CN) ..... 201810811153.2

(51) Int. Cl.

| | |
|---|---|
| ***H01Q 1/24*** | (2006.01) |
| ***H01Q 1/36*** | (2006.01) |
| ***H01Q 9/22*** | (2006.01) |
| ***H01Q 5/321*** | (2015.01) |
| ***H01Q 21/26*** | (2006.01) |
| ***H01Q 1/52*** | (2006.01) |
| ***H01Q 21/10*** | (2006.01) |

(52) U.S. Cl.

CPC ..... *H01Q 1/246* (2013.01); *H01Q 1/36* (2013.01); *H01Q 1/52* (2013.01); *H01Q 5/321* (2015.01); *H01Q 9/22* (2013.01); *H01Q 21/10* (2013.01); *H01Q 21/26* (2013.01)

(58) Field of Classification Search

CPC ..... H01Q 1/246; H01Q 9/28; H01Q 9/16; H01Q 21/062; H01Q 9/285; H01Q 25/00

See application file for complete search history.

(56) References Cited

U.S. PATENT DOCUMENTS

| | | | | |
|---|---|---|---|---|
| 9,570,804 | B2 | 2/2017 | Shang et al. | |
| 2007/0139289 | A1* | 6/2007 | Lee | H01Q 9/22 343/792 |
| 2012/0044119 | A1* | 2/2012 | Libonati | H01Q 9/28 343/807 |
| 2015/0214617 | A1* | 7/2015 | Shang | H01Q 1/246 343/722 |

FOREIGN PATENT DOCUMENTS

| | | |
|---|---|---|
| WO | 2017/165512 A1 | 9/2017 |

* cited by examiner

*Primary Examiner* — Kwasi Karikari
(74) *Attorney, Agent, or Firm* — Myers Bigel, P.A.

(57) ABSTRACT

A dipole arm assembly for a low frequency band radiator of a cellular base station antenna comprising: a central shaft; and at least one barrel having a first end, a second end, and a peripheral wall located between the first end and the second end, where the first end includes an end wall provided with an engagement portion, and the barrel is engaged with the central shaft through the engagement portion and disposed about the central shaft.

22 Claims, 3 Drawing Sheets

DIPOLE ARM ASSEMBLY

CROSS-REFERENCE TO RELATED APPLICATION

The present application claims priority under 35 U.S.C. § 119 to Chinese Patent Application No. 201810811153.2 (Serial No. 2018072400713300), filed Jul. 23, 2018, the entire content of which is incorporated herein by reference.

FIELD OF THE INVENTION

The present disclosure generally relates to cellular base station antennas and, more particularly, to dipole arm assemblies for low frequency band radiators of cellular base station antennas.

BACKGROUND

A cellular communication system connects a user's cellular device to a wireless network through a base station. The base station includes a baseband unit, a radio, and a base station antenna that performs bi-directional radio frequency communication with the user. The base station antenna may be mounted on a tower or other raised structure and generates an outwardly directed radiation beam to serve a corresponding geographic region.

Multi frequency band base station antennas are base station antennas that are designed to operate in two or more of the cellular frequency bands. For example, a dual frequency band base station antenna includes at least one or more low frequency band radiators and one or more high frequency band radiators. One known low frequency band radiator has a central feed portion and a dipole (or a pair of dipoles) arranged on the central feed portion. Each dipole includes a pair of dipole arms with a certain length. As shown in FIGS. 1A and 1B, the dipole arm 100' includes a central shaft 110' and a plurality of hollow tubes 120' that are spaced apart along the central shaft 110'. The central shaft 110' includes a stem portion 111' and a plurality of circular flanges 112' that project radially outward from the stem portion 111'. The flanges 112' and the stem portion 111' are integrally formed. The hollow tubes 120' are fixed to the central shaft 110' by engaging the bottom of each hollow tube 120' with a respective one of the flanges 112'.

The stem portion 111' and the flanges 112' of the central shaft 110' are integrally formed by means of cutting using a numerically controlled lathe, which involves high production costs. The central shaft 110' is easily deformed during high-speed cutting, resulting in difficult machining and a high rejection ratio. In addition, a large amount of raw materials need to be cut away during lathe machining, so that there is a low utilization ratio of the material.

The hollow tube 120' is formed by extruding a raw material that is cut into segments, and the bottom portion of each tube then undergoes high precision machining. Consequently, manufacturing the hollow tubes 120' is also time-consuming and labor-intensive, and has high production costs.

The bottom of each hollow tube 120' is fitted to a respective flange 112' of the central shaft 110' by rolling. The rolling process is a low efficiency process and may sometimes produce a loose engagement between the inner surface of the hollow tube 120' and the outer surface of a corresponding flange 112', which may affect the subsequent performance parameters of the antenna.

SUMMARY

According to a first aspect of the present disclosure, dipole arm assemblies for a low frequency band radiator of a cellular base station antenna are provided that include a central shaft and at least one barrel having a first end, a second end, and a peripheral wall located between the first end and the second end. The first end includes an end wall provided with an engagement portion, and the barrel is engaged with the central shaft through the engagement portion and disposed about the central shaft.

In one embodiment, the second end is open outwardly.

In one embodiment, the at least one barrel is circular or elliptical in cross-section.

In one embodiment, the at least one barrel comprises a metallic material.

In one embodiment, the at least one barrel includes a plurality of barrels axially spaced apart along the central shaft.

The plurality of barrels may have the same structure or different structures.

The plurality of barrels may have the same diameter or different diameters, and may have the same axial length or different axial lengths.

In one embodiment, the plurality of barrels have sequentially incremental axial lengths along the central shaft.

In one embodiment, the second ends of the plurality of barrels are open outwardly towards the same direction.

In one embodiment, the at least one barrel is mechanically engaged and electrically connected with the central shaft by the engagement portion.

In one embodiment, the engagement portion includes a hole provided at the center of the end wall through which the central shaft passes through.

In one embodiment, the engagement portion includes a protrusion extending about the hole inwardly from the end wall along an axial direction.

The distance by which the protrusion extends inwardly along an axial direction may be, for example, less than an axial length of the peripheral wall, less than one-half of an axial length of the peripheral wall or less than one-quarter of an axial length of the peripheral wall.

In one embodiment, the hole and the protrusion may have cross-sections that match the size and shape of the central shaft.

In one embodiment, the central shaft may be fitted in the protrusion by an interference fit.

In one embodiment, transverse cross-sections of the central shaft may have the same shape.

In one embodiment, the central shaft may be circular, polygonal, or elliptical in cross-section.

In one embodiment, the central shaft may be made of aluminum, aluminum alloy, or other metallic materials.

In one embodiment, the space between the barrel and the central shaft may be completely filled or partially filled with a dielectric material.

In one embodiment, the dipole arm may have a length of approximately one-quarter wavelength ($\lambda/4$) or one-half wavelength ($\lambda/2$).

In one embodiment, the dipole arm assembly may be in combination with a second dipole arm and a central feed portion to form the low frequency band radiator, the low frequency band radiator being part of a base station antenna.

In one embodiment, adjacent barrels may be positioned to form a radio frequency choke that interrupt currents from a high band radiator that is included in the base station antenna.

According to another aspect of the present disclosure, a method for manufacturing a dipole arm is provided in which metallic raw material is extruded to form a column which is cut into segments to form a central shaft. The metallic raw material is deeply punched to form at least one barrel having a first end, a second end, and a peripheral wall between the first end and the second end, where the first end includes an end wall provided with an engagement portion. The central shaft and the at least one barrel are assembled together using the engagement portion.

DETAILED DESCRIPTION

Figure 1A:
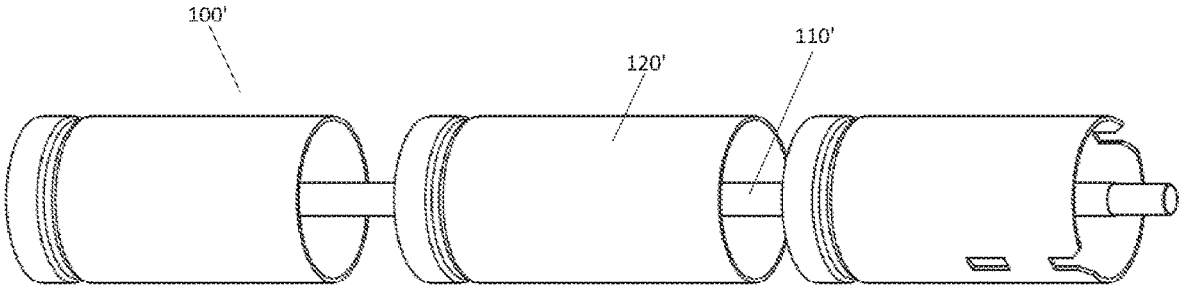
FIG. 1A (Prior Art)
FIGS. 1A and 1B are a perspective view and a cross-sectional view of a conventional existing dipole arm.
Figure 1B:
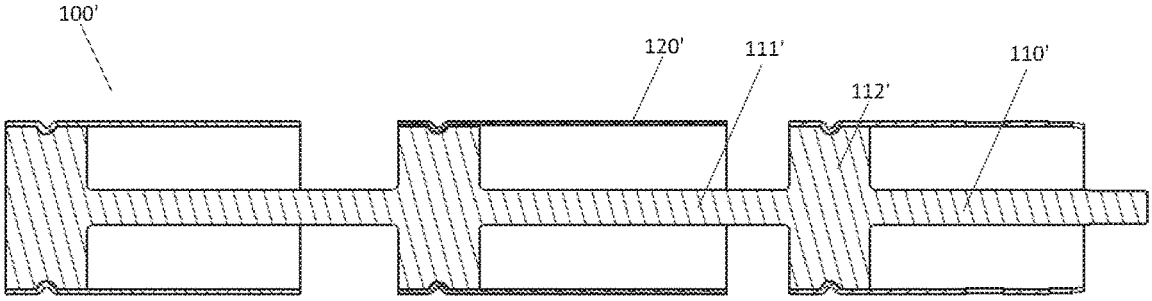
FIG. 1B (Prior Art)

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, in all the drawings, the same reference signs refer to the same elements. In the drawings, for the sake of clarity, the sizes of certain features may be deformed.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail.

The singular forms "a/an", "said" and "the" as used in the specification, unless clearly indicated, all contain the plural forms. The wordings "comprising", "containing" and "including" used in the specification indicate the presence of the claimed features, but do not exclude the presence of one or more other features. The wording "and/or" as used in the specification includes any and all combinations of one or more of the relevant items listed.

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or one or more intermediate elements may be present. By contrast, where one element is referred to as being "directly" on another element, "directly attached to" another element, "directly connected to" another element, "directly coupled to" another element, or "in direct contact with" another element, there will not be any intermediate elements present. In the specification, where one feature is arranged to be "adjacent" to another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations). At this time, the relative spatial relations will be explained correspondingly.

A low frequency band radiator of a dual frequency band cellular base station will be disclosed hereinafter. The following description will disclose a number of specific details including the shape and material of the dipole arm, as well as the dielectric material and the like. However, it should be clear to those skilled in the art that various modified solutions and/or alternative solutions may be set forth for the aforementioned details without departing from the scope and spirit of the present disclosure, and certain details may also be omitted.

In some embodiments, the low frequency band may be a frequency band such as 698 to 960 MHz (or a portion thereof), while the high frequency band may be a frequency band such as 1695 MHz to 2690 MHz or a portion thereof. However, the present disclosure is not limited to these frequency bands. For example, the low frequency band may further include low frequencies (e.g., the 600 MHz band) and/or the high frequency band may further include the 1400 MHz band. A "low frequency band radiator" refers to a radiator that is configured to operate in the low frequency band, and a "high frequency band radiator" refers to a radiator that is configured to operate in the high frequency band. Throughout the present disclosure, "dual frequency band" includes at least a low frequency band and a high frequency band. It will also be appreciated that herein the term "dual frequency band antenna" refers not only to antennas that operate in the low frequency band and the high frequency band, but also to antennas that operate in one or more additional frequency bands such as, for example, the 3.5 GHz frequency band or the 5 GHz frequency band.

The embodiments of the present disclosure relate generally to a dual frequency band cellular base station antenna. The use of dual frequency band antennas may enable an operator of a cellular communication system to use a single type of antenna to cover multiple frequency bands using a single antenna, which may allow the operator to reduce the number of antennas in its network, thereby reducing the rental cost of a tower, and at the same time accelerating the marketing ability. The dual frequency band cellular base station antenna supports multiple frequency bands and technical standards.

More specifically, embodiments of the present disclosure relate to a dual frequency band antenna for a cellular base station. In some embodiments, the dual frequency band antenna may be configured to operate in a low frequency band of 698 MHz to 960 MHz or a part thereof as well as in a high frequency band of 1695 MHz to 2690 MHz or a part thereof.

Figure 2:
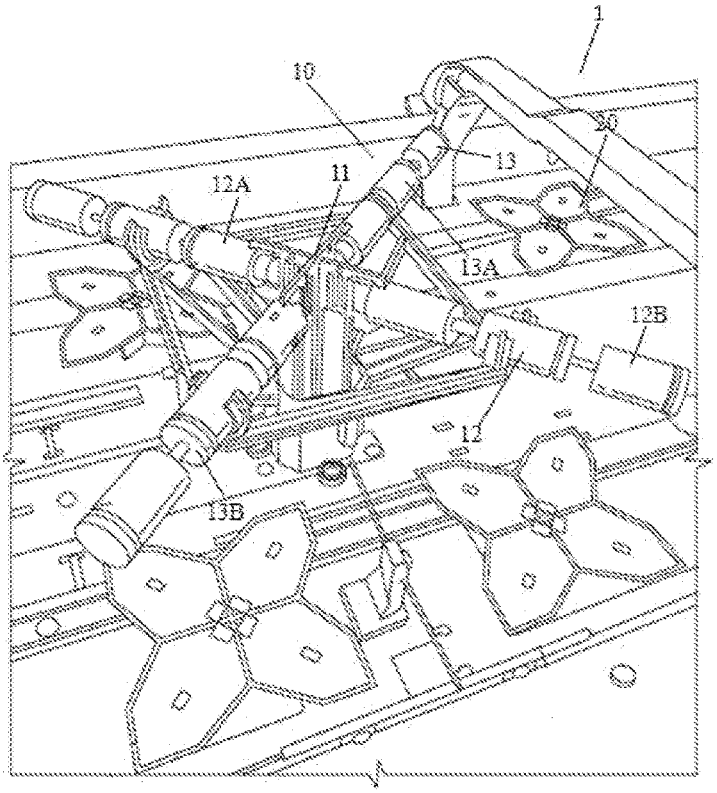
FIG. 2 is a schematic view of a portion of a dual-frequency band cellular base station antenna.

FIG. 2 shows a schematic view of a portion of a dual frequency band cellular base station antenna. The dual frequency band cellular base station antenna 1 includes a plurality of low frequency band radiators 10 (only one of which is visible in FIG. 2) and a plurality of high frequency band radiators 20. In the illustrated example, the high frequency band radiator 20 includes four high frequency band radiators arranged in a 2×2 matrix, and one low frequency band radiator 10 is interposed between the four high frequency band radiators.

As shown in FIG. 2, the low frequency band radiator 10 includes a central feed portion 11 in a cross shape, and a −45 degree slant dipole 12 and a +45 degree slant dipole 13 that are arranged on the central feed portion 11 and perpendicular to each other. The central feed portion 11 includes two cross-interlocked printed circuit boards ("PCBs"). Feed lines for the −45 degree slant dipole 12 and the +45 degree slant dipole 13 are formed on the two cross-interlocked PCBs. The central feed portion 11 supports the −45 degree slant dipole 12 and the +45 degree slant dipole 13 at a certain height above a reflection plate of the antenna 1, preferably at a height of one-quarter wavelength (λ/4).

Four high frequency band radiators 20 are arranged about the four quadrants. By repeating the pattern shown in FIG. 2, the entire base station antenna 1 may be constructed.

The −45 degree slant dipole 12 includes a pair of dipole arms 12A and 12B with a certain length, and the +45 degree slant dipole 13 includes a pair of dipole arms 13A and 13B with a certain length. The dipole arms 12A and 12B may have a length that is the same as or different from the dipole arms 13A and 13B. In some embodiments, the dipole arms 12A, 12B, 13A, and 13B may have a length of approximately one-quarter wavelength (λ/4) or one-half wavelength (λ/2), although embodiments of the present invention are not limited thereto.

Figure 3A:
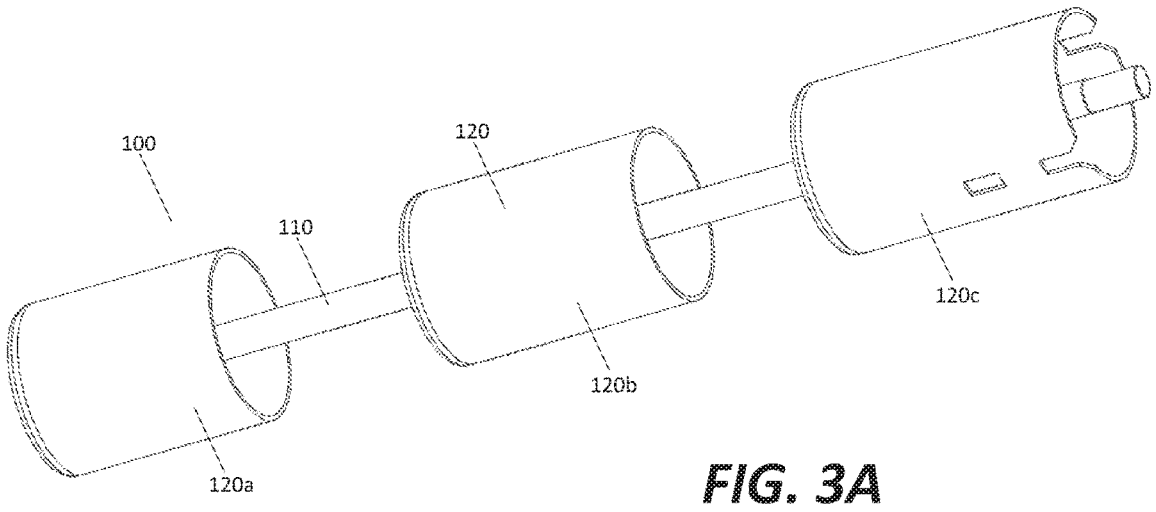
FIGS. 3A and 3B are a perspective view and a cross-sectional view of a dipole arm according to an embodiment of the present disclosure.
Figure 3B:
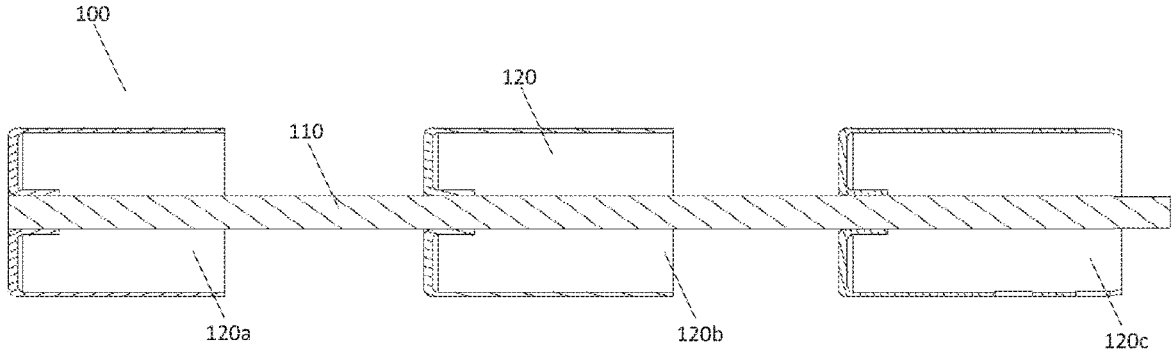

FIGS. 3A and 3B illustrate a dipole arm 100 for a low frequency band radiator 10 of a cellular base station antenna 1, which may be used to implement any one of the dipole arms 12A, 12B, 13A, and 13B shown in FIG. 2. The dipole arm 100 includes a central shaft 110, and a plurality of barrels 120 that are axially spaced along the central shaft 110 and arranged about the central shaft 110. In the illustrated example, the dipole arm 100 includes three barrels 120*a*, 120*b*, and 120*c*, but it will be understood that the dipole arm 100 may include more than three or less than three barrels 120.

The dipole arm arrangement shown in FIGS. 3A and 3B creates a series of coaxial RF chokes along the length of the dipole arm 100. In particular, the gap between barrel 120*a* and barrel 120*b* acts as a first coaxial choke and the gap between barrel 120*b* and 120*c* acts as a second coaxial choke. These gaps may interrupt currents of RF signals emitted by the high frequency band radiators. Consequently, RF energy emitted by the high frequency band radiators will not tend to flow on the dipole arm 100, and hence the low band radiators may have little or no impact on the radiation pattern of the high band radiators. In other words, the barrels 120 are used to form a series of RF chokes along the dipole arm 100 that may render the dipole arm 100 substantially invisible to RF energy in the high frequency band.

In some embodiments, the space between the barrel 120 and the central shaft 110 may be filled with air. As an alternative solution, the space between the barrel 120 and the central shaft 110 may be completely filled or partially filled with a solid or foamed dielectric material.

Figure 4:
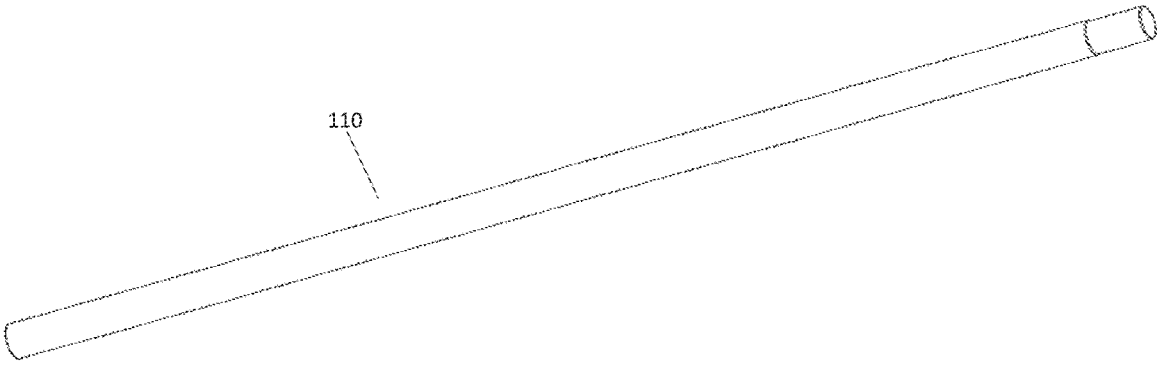
FIG. 4 is a perspective view of a central shaft of a dipole arm according to an embodiment of the present disclosure.

As shown in FIG. 4, the central shaft 110 is in the shape of a straight column, and may be made of aluminum, aluminum alloy, or other metallic materials. The central shaft 110 is circular in cross-section; however, it the central shaft 110 may alternatively be polygonal or elliptical in cross-section. The central shaft 110 may have a constant transverse cross-section. For example, in the depicted embodiment where the central shaft 110 has a circular transverse cross-section, the diameter of the transverse cross-section may be constant along the entire length of the central shaft 110. In some embodiments, an end of the central shaft 110 that mounts to the central feed portion 111 may have a different cross section than the remainder of the central shaft 110 to facilitate mounting the central shaft 110 on the central feed portion 111. The central shaft 110 may have a length of between 99 mm and 104 mm, and a diameter of 3.0 mm, in an example embodiment.

Figure 5A:
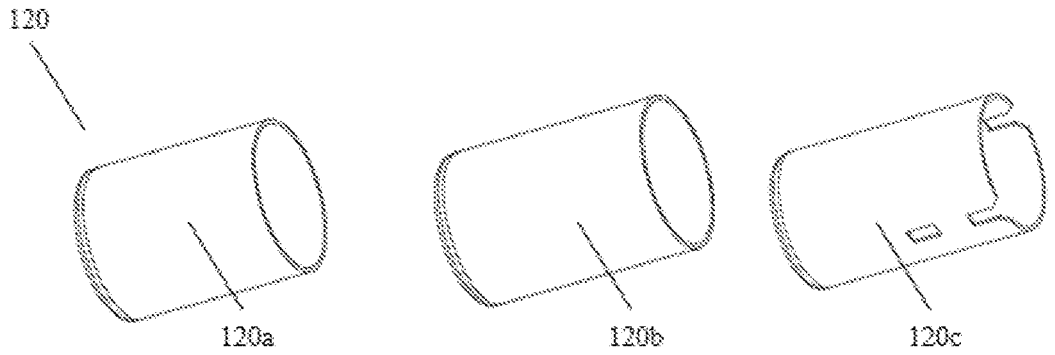
FIGS. 5A and 5B are a perspective view and a cross-sectional view of a barrel of a dipole arm according to an embodiment of the present disclosure.
Figure 5B:
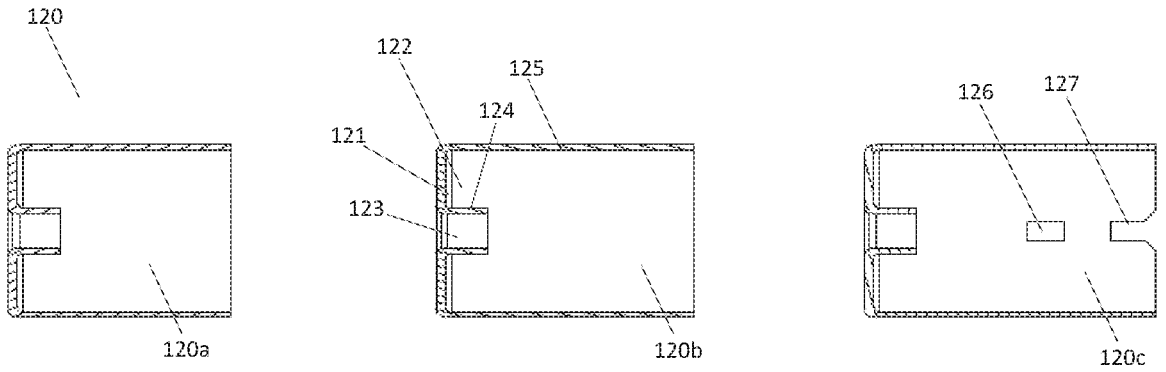

As shown in FIGS. 5A and 5B, each barrel 120 includes two ends, and a peripheral wall 125 located between the two ends. One end of each barrel 120 includes an end wall 121 and the other end is open outwardly. The barrels 120 may be made of aluminum, an aluminum alloy, or other metallic materials. Each barrel 120 may have a circular transverse cross-section; however, it may be contemplated that the barrel 120 may alternatively have an elliptical, rectangular or other transverse cross-section in other embodiments. The end wall 121 is provided with an engagement portion 122 that is mechanically engaged and electrically connected with the central shaft 110.

In some embodiments, the engagement portion 122 includes a hole 123 provided at the center of the end wall 121, and a protrusion 124 extending around the hole 123 inwardly from the end wall 121 along an axial direction. The hole 123 and the protrusion 124 may have a cross-section that matches the size and shape of a corresponding portion of the central shaft 110 that the barrel 120 will be mounted on, so that the central shaft 110 can pass through the protrusion 124 and/or the hole 123, and the outer surface of the central shaft 110 is closely attached to the inner surface of the protrusion 124 when the barrel 120 is mounted on the central shaft 110. The distance by which the protrusion 124 extends inwardly along an axial direction is less than an axial length of the peripheral wall 125, in some embodiments less than one-half the axial length of the peripheral wall 125, and in further embodiments less than one-quarter the axial length of the peripheral wall 125.

The plurality of barrels 120 may have the same or different structures. In some embodiments, as shown in FIGS. 5A and 5B, the peripheral wall 125 of the barrel 120*c* is provided with an orifice 126 and a cutout 127 for connection and fixation with a PCB of the central feed portion 111, and the peripheral walls of the barrels 120*a* and 120*b* are not provided with any orifices and cutouts.

The plurality of barrels 120 may have the same or different diameters, and the same or different axial lengths. In some embodiments, the plurality of barrels 120 may have the same diameter (e.g., 16.0 mm), but different axial lengths. For example, the axial length of barrel 120*c* (e.g., 31.5 mm) is greater than that of barrel 120*b* (e.g., 28.5 mm), which is greater than that of barrel 120*a* (e.g., 25.5 mm).

In general, the barrel 120 and the central shaft 110 may have an optimized size so that the radiation pattern of the high frequency band radiator 20 is not affected by the low frequency band radiator 10 to a great extent.

A method for producing the dipole arm 100 will be introduced below in combination with FIGS. 3A-3B. First, the metallic raw material is extruded to form a column which is cut into segments to form a central shaft 110. Then, metallic raw material is deeply punched to form a plurality of barrels 120*a*, 120*b*, and 120*c*. Then, the central shaft 110 is inserted into the protrusions of the barrels 120*a*, 120*b* and 120*c* in such a manner that the openings of the plurality of barrels 120 face in the same direction, and the central shaft 110 and the barrels 120*a*, 120*b*, and 120*c* are assembled together, by an interference fit between the outer surface of the central shaft 110 and the inner surface of the protrusion 124, so as to form the dipole arm 100.

The dipole arm 100 of the invention is suitable for automatic mass production with a highly stable quality, and can achieve superior passive intermodulation (PIM) distortion performance.

Although the exemplary embodiments of the present disclosure have been described, a person skilled in the art should understand that, he or she can make multiple changes and modifications to the exemplary embodiments of the present disclosure without substantively departing from the spirit and scope of the present disclosure. Accordingly, all the changes and modifications are encompassed within the protection scope of the present disclosure as defined by the claims. The present disclosure is defined by the appended claims, and the equivalents of these claims are also contained therein.

That which is claimed is:

1. A dipole arm assembly for a low frequency band radiator of a cellular base station antenna comprising:

a central shaft; and at least one barrel having a first end, a second end, and a peripheral wall located between the first end and the second end, wherein the first end includes an end wall provided with an engagement portion, and the barrel is engaged with the central shaft through the engagement portion and disposed about the central shaft.

2. The dipole arm assembly according to claim 1, wherein the at least one barrel includes a plurality of barrels axially spaced apart along the central shaft.

3. The dipole arm assembly according to claim 2, wherein the plurality of barrels have different axial lengths.

4. The dipole arm assembly according to claim 2, wherein the plurality of barrels have sequentially incremental axial lengths along the central shaft.

5. The dipole arm assembly according to claim 1, wherein the at least one barrel is mechanically engaged and electrically connected with the central shaft by the engagement portion.

6. The dipole arm assembly according to claim 1, wherein the engagement portion includes a hole provided at the center of the end wall through which the central shaft passes through.

7. The dipole arm assembly according to claim 6, wherein the engagement portion includes a protrusion extending about the hole inwardly from the end wall along an axial direction.

8. The dipole arm assembly according to claim 7, wherein the distance by which the protrusion extends inwardly along an axial direction is less than an axial length of the peripheral wall.

9. The dipole arm assembly according to claim 1, wherein the dipole arm has a length of approximately one-quarter wavelength ($\lambda/4$) or one-half wavelength ($\lambda/2$).

10. The dipole arm assembly according to claim 1, in combination with a second dipole arm and a central feed portion to form the low frequency band radiator, the low frequency band radiator being part of a base station antenna.

11. The dipole arm according to claim 10, wherein adjacent barrels are positioned to form a radio frequency choke that interrupt currents from a high band radiator that is included in the base station antenna.

12. A dipole arm assembly for a low frequency band radiator of a cellular base station antenna comprising:

a central shaft; and a first barrel having a first end, a second end, and a peripheral wall located between the first end and the second end, wherein the first end comprises an end wall that includes a central opening that receives the central shaft.

13. The dipole arm assembly according to claim 12, wherein the first barrel further includes an annular cylinder that is within the peripheral wall and spaced apart from the peripheral wall, the annular cylinder being coaxial with the central opening.

14. The dipole arm assembly according to claim 12, further comprising a second barrel and a third barrel which each have a first end, a second end, and a peripheral wall located between the first end and the second end, wherein the first end of each of the second barrel and the third barrel comprises an end wall that includes a central opening that receives the central shaft.

15. The dipole arm assembly according to claim 12, wherein the central shaft is fitted within the central opening by an interference fit.

16. The dipole arm assembly according to claim 2, wherein the portions of the central shaft that are engaged by each of the barrels have the same transverse cross-section.

17. The dipole arm assembly according to claim 2, wherein the second end of each barrel is open, and wherein the second end of each barrel is closer to a center of the radiating element than the first end of each respective barrel.

18. The dipole arm assembly according to claim 1, wherein the at least one barrel comprises a first barrel and a second barrel and the engagement portion comprises a first engagement portion, wherein the first barrel is mechanically engaged and electrically connected with the central shaft by the first engagement portion and the second barrel is mechanically engaged and electrically connected with the central shaft by a second engagement portion, wherein the first engagement portion includes a first hole that receives the central shaft and the second engagement portion includes a second hole that receives the central shaft, and wherein the first hole and the second hole are the same size.

19. The dipole arm assembly according to claim 1, wherein the central shaft is a unitary shaft and the portions of the central shaft that are within the at least one barrel have the same transverse cross-section.

20. The dipole arm assembly according to claim 14, wherein the second end of the first barrel is in between the first end of the first barrel and the first end of the second barrel.

21. A dipole arm assembly for a low frequency band radiator of a cellular base station antenna comprising:

a central shaft; and a first barrel and a second barrel, each of which has a first end, a second end, and a peripheral wall located between the first end and the second end, wherein the first end comprises an end wall that includes a central opening that receives the central shaft, wherein the second end of the first barrel is in between the first end of the first barrel and the first end of the second barrel.

22. The dipole arm assembly according to claim 21, wherein the portions of the central shaft that are engaged by each of the first and second barrels have the same transverse cross-section.

* * * * *